US008833809B2

(12) United States Patent
Liang et al.

(10) Patent No.: US 8,833,809 B2
(45) **Date of Patent: *Sep. 16, 2014**

(54) WINDOW VENT STOP WITH FLEXIBLE SIDE ENGAGEMENT PIECES

(75) Inventors: Luke Liang, South Plainfield, NJ (US); Tong Liang, Guangzhou (CN); David Chen, Guangzhou (CN)

(73) Assignee: Vision Industries Group, Inc., So. Plainfield, NJ (US)

( * ) Notice: Subject to any disclaimer, the term of this patent is extended or adjusted under 35 U.S.C. 154(b) by 478 days.

This patent is subject to a terminal disclaimer.

(21) Appl. No.: 12/658,642

(22) Filed: Feb. 9, 2010

(65) Prior Publication Data

US 2010/0281780 A1 Nov. 11, 2010

Related U.S. Application Data

(60) Division of application No. 11/977,445, filed on Oct. 24, 2007, now Pat. No. 8,235,430, which is a continuation-in-part of application No. 11/390,467, filed on Mar. 28, 2006, now Pat. No. 7,530,611.

(51) Int. Cl.
*E05C 3/12* (2006.01)

(52) U.S. Cl.
USPC ..... 292/219; 292/220; 292/228; 49/449

(58) Field of Classification Search
USPC ..... 49/449; 292/219, 220, 228, DIG. 47, 292/DIG. 46, DIG. 20, DIG. 33
See application file for complete search history.

(56) References Cited

U.S. PATENT DOCUMENTS

| | | | | | |
|---|---|---|---|---|---|
| 4,824,154 | A * | 4/1989 | Simpson | 292/338 |
| 4,923,230 | A * | 5/1990 | Simpson | 292/67 |
| 5,248,174 | A * | 9/1993 | Matz et al. | 292/338 |
| 5,536,052 | A * | 7/1996 | Maier | 292/63 |
| 5,806,900 | A * | 9/1998 | Bratcher et al. | 292/137 |
| 6,572,158 | B2 * | 6/2003 | Szapucki et al. | 292/221 |
| 6,854,214 | B2 * | 2/2005 | Polowinczak | 49/449 |
| 7,530,611 | B2 * | 5/2009 | Liang et al. | 292/338 |
| 8,235,430 | B2 * | 8/2012 | Liang et al. | 292/338 |

* cited by examiner

*Primary Examiner* — Gregory J. Strimbu
(74) *Attorney, Agent, or Firm* — Thomas A. O'Rourke; Bodner & O'Rourke, LLP

(57) ABSTRACT

A window vent stop for use in a sliding member of a sliding sash window assembly or a sliding door assembly. The vent stop has a housing adapted to be disposed in a recess in the non-movable sash member of the assembly. This housing includes a cavity with a bottom plate. A tumbler has at least one pivot for pivotally securing the tumbler to the housing for movement between an extended position, to prevent movement of the sliding member and a retracted position, to allow movement of the sliding member. Also within the housing is a spring for biasing the tumbler toward the extended position. The housing has one or more flexible members extending from the end walls of the housing that secure the housing to the non-movable sash member.

11 Claims, 15 Drawing Sheets

WINDOW VENT STOP WITH FLEXIBLE SIDE ENGAGEMENT PIECES

This application is a division of patent application Ser. No. 11/977,445, filed Oct. 24, 2007, now issued as U.S. Pat. No. 8,235,430, which is a continuation-in-part of U.S. application Ser. No. 11/390,467, filed Mar. 28, 2006, now issued as U.S. Pat. No. 7,530,611, the disclosures of which are incorporated herein by reference.

FIELD OF THE INVENTION

The present invention relates to improved window vent stops particularly for double hung windows and the like and to improvements, in their operation. These window vent stops are used to prevent a window or door from opening more than a desired amount.

BACKGROUND OF THE INVENTION

There are a number of different types of window vent stops available on the market. An example of a window vent stop mechanism is shown in U.S. application Ser. No. 11/390,467, filed Mar. 28, 2007, the disclosures of which are herein incorporated herein by reference. These window vent stops are used to restrict the opening of windows and doors. For example, a window may be opened only a portion due to security concerns or to increase comfort in the room. Window vent stops are primarily used on double hung windows and sliding doors where a sash or a door member slides from a first position to a second position. The window sash lock prevents the sash or the sliding door from moving past a selected point. These sash locks can permit the window to be opened a desired amount for ventilation or other purposes.

There are many different types of windows currently available. These windows include casement windows, transom windows, single hung windows, double hung windows, sliding windows, etc. Double hung windows are windows that have a pair of window sashes that may be raised and lowered. Each sash resides in a pair of tracks or recesses that are typically at each side edge of the window. This permits the lower sash to be raised and the upper sash to be lowered. Traditionally, most windows were made of wood. More recently, the windows including the window sashes have been made of extruded metal or plastic.

Single hung windows are similar in design to double hung windows except that there is only one sash that may be raised or lowered. Sliding windows are also not unlike double hung windows in design. While a double hung window has sashes that are raised and lowered, a sliding window has sashes that are movable along a track to the right or left. Similarly, sliding doors operate the same way as sliding windows.

Double hung windows, single hung windows, sliding windows and sliding doors have a variety of open positions in which they may be placed. While a fully opened position can be desirable for ventilation purposes there can be a downside to the fully opened position. One downside is security. A fully open window or door, however, can be a location for unauthorized ingress and egress from the premises. For example, a double hung window that is opened wide can be a source of danger to small children who may climb up to the window. As a result, many municipalities have enacted laws requiring window guards. Additionally, an opened window or door can provide an invitation to third parties to gain access to the building. As a result, there are a number of vent stops that are available to secure a window or door having sliding members in a partially opened position. One such stop is shown in U.S. Pat. No. 5,248,174 owned by Ashland Products. Another sash stop is shown in U.S. Pat. No. 4,923,230 owned by Ro Mai. In each of these sash stops there is a spring biased tumbler or dog that pivots from an unlocked position to a locked position as desired. These sash locks are positioned in the frame of the upper sash and when the tumbler is pivoted outwardly the position of the tumbler prevents the lower sash from being raised above a preselected position. Other prior art patents for similar products are U.S. Pat. Nos. 5,553,903 and 5,806,900 both of which are owned by Ashland.

One particular problem encountered, however, by users of window vent stops is that the installation becomes a difficult process. In order to install the window vent stop properly, a recess must be cut into the sash stile of the window. This recess must be wide enough to allow the vent stop's initial insertion into the recess, but it must also be snug enough that the vent stop will remain securely installed and able to serve its purpose of preventing the window from being opened wider than a specified distance. Problems occur when a mold of the window vent stop to be installed is used to carve the recess. At times due to mistakes by the person installing or the inaccuracies of the mold used to carve the recess, the recess cut into the sash stile is often riot exactly a perfect fit for the vent stop, whether it be too large or too small. Therefore, a new vent stop must be purchased in these situations.

Another problem with the prior art vent stops, is that if a user wants a particular vent stop, that user must purchase a vent stop that is specifically fit for the sash stile thickness of that user's windows. If a user purchases and attempts to install a window vent stop that is either too big or too small for the sash stile in the window, that user must purchase a new window vent stop.

Thus, there is a need in the art for window vent stops with the ability to be used with sash stiles of various thicknesses and with recesses of variable sizes. This would save a user time and money in the installation of the window vent stop. The present invention fulfills this need by using flexible side engagement pieces which allow a particular vent stop to be installed in virtually any sash stile.

OBJECTS OF THE INVENTION

It is an object of the present invention to provide a vent stop that can be installed more easily than the prior art vent stops.

It is another object of the present invention to provide an improved vent stop that is more dependable in its operation than the prior art vent stops.

It is a further object of the present invention to provide a vent stop that provides a mechanism that permits the vent stop to be installed in a variety of different window types and sizes.

It is still another object of the present invention to provide a vent stop that is more flexible in its ability to fit into a variety of recesses carved into a sash stile.

It is still another object of the present invention to provide a vent stop that is more flexible in its ability to fit into a variety of recesses routed into a sash stile.

It is a still further object of the present invention to provide a vent stop that has flexible side engagement pieces which permit the vent stop to be installed in a variety of window types.

SUMMARY OF THE INVENTION

The present invention is directed to an improved vent stop or sash lock for use in a sliding sash window assembly or a sliding door assembly. The window may have one or more sashes usually upper and lower sash window frames installed for vertical sliding movement. Alternatively, the window may have left and right horizontal sliding sashes. The door may also have one or more sliding doors. One sash frame or sliding door frame has a recess into the interior thereof. The vent stop has a housing adapted to be disposed in the recess.

This housing includes a cavity, usually with a bottom plate therein. Inside the cavity is a tumbler that may be in a retracted position and an extended position. When the tumbler is in an extended position the tumbler has a protruding apex at the top. The apex prevents a sash or door from moving when the apex contacts the sash or the door. The tumbler has at least one pivot means for pivotally securing said tumbler to said housing for movement between the extended position and the retracted position. In the extended-position the bottom of the tumbler overlies a portion of the second sash to prevent movement of the lower sash past the tumbler. When in a retracted position within said cavity the sash or door can be raised and/or moved past the tumbler without interference. Also within the housing is a spring means for biasing said tumbler into the extended position. The tumbler has at least one means for retaining the tumbler within the housing. The retaining means may be one or more pins that extend laterally from the side of the tumbler and ride within an opening in the sidewall of the housing. Alternatively, the interior wall of the housing may have one or more pins extending toward the tumbler and riding within an opening in the tumbler's side wall.

The housing also has at least one side engagement piece, preferably two, which is preferably made from the same type of material as the housing and is flexible and bendable with the shape of the recess cut into the sash stile into which the window vent stop is placed. These side engagement pieces are intended to aid in the installation of the window vent stop into the sash stile and are flexible so as to enable the installation of the window vent stop in a wide variety of sash stiles of different sizes.

DETAILED DESCRIPTION OF THE PRESENT INVENTION

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
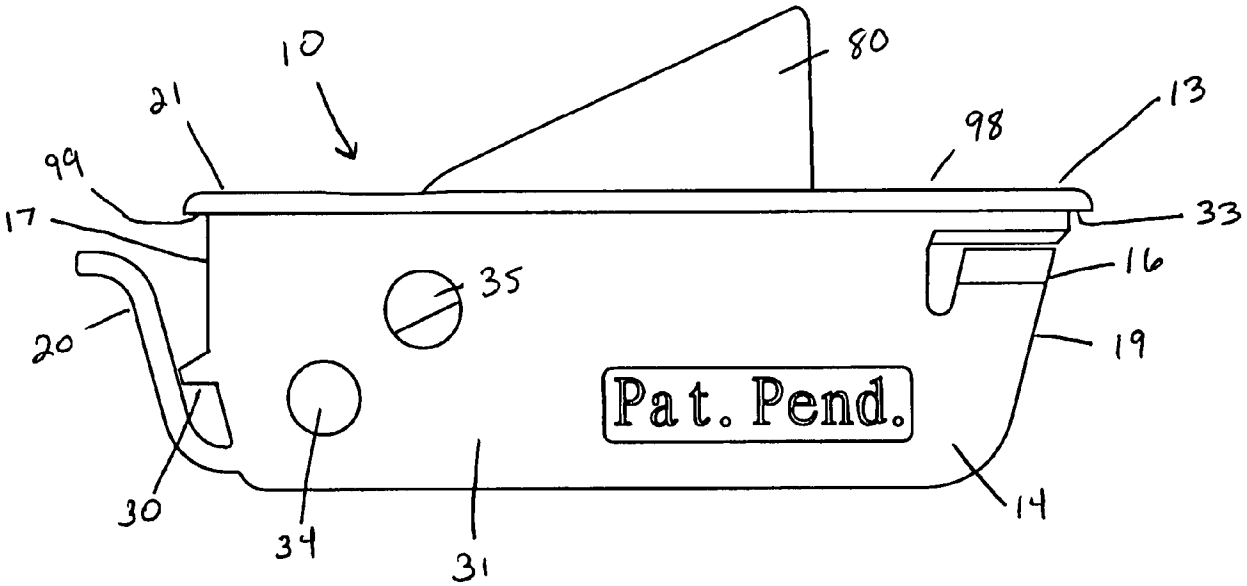
FIG. 1 is a side view of a preferred embodiment of the vent stop of the present invention with the tumbler in the extended position.
Figure 5:
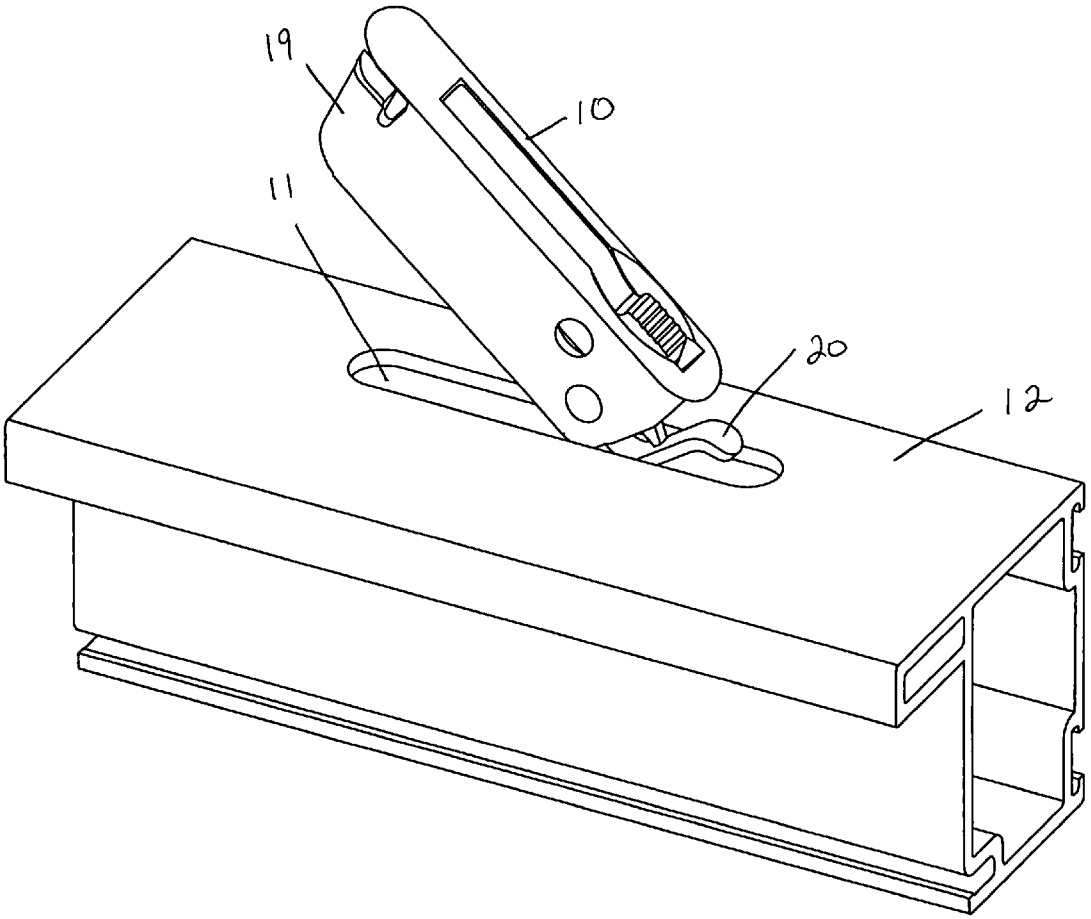
FIG. 5 is a top perspective view of the vent stop of FIG. 1 positioned over a slot in a window or door sash.
Figure 8:
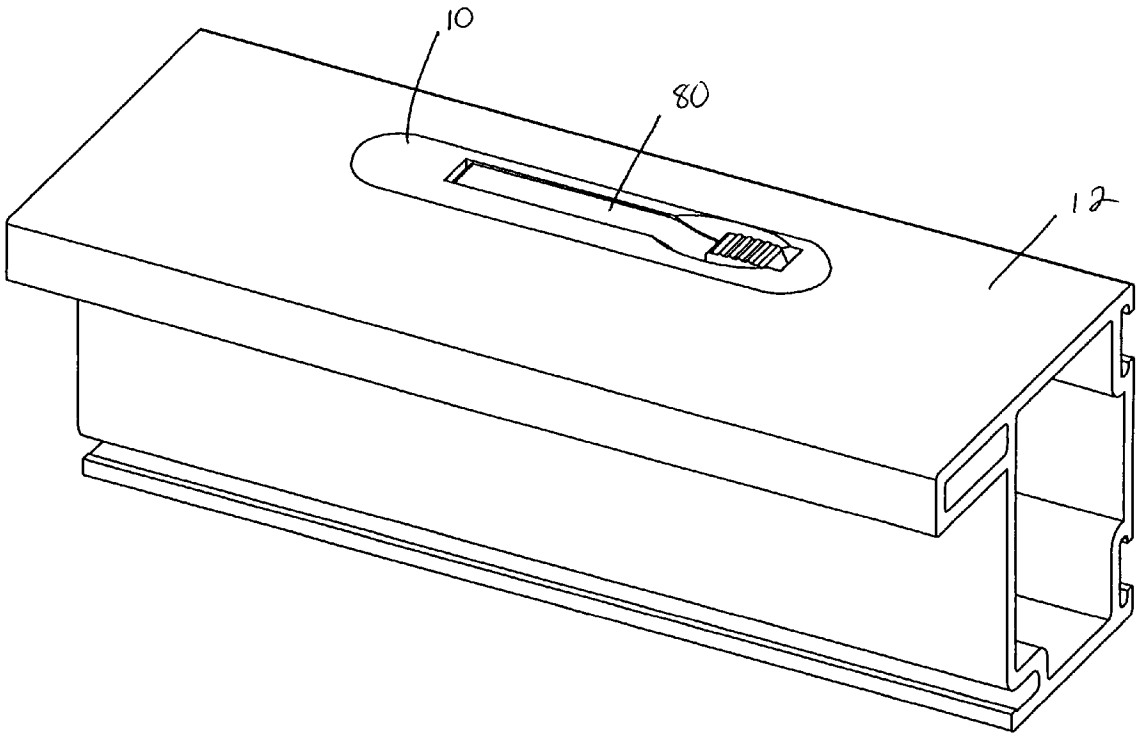
FIG. 8 is a top perspective view of the vent stop of FIG. 1 fully installed in a window or door sash.
Figure 9:
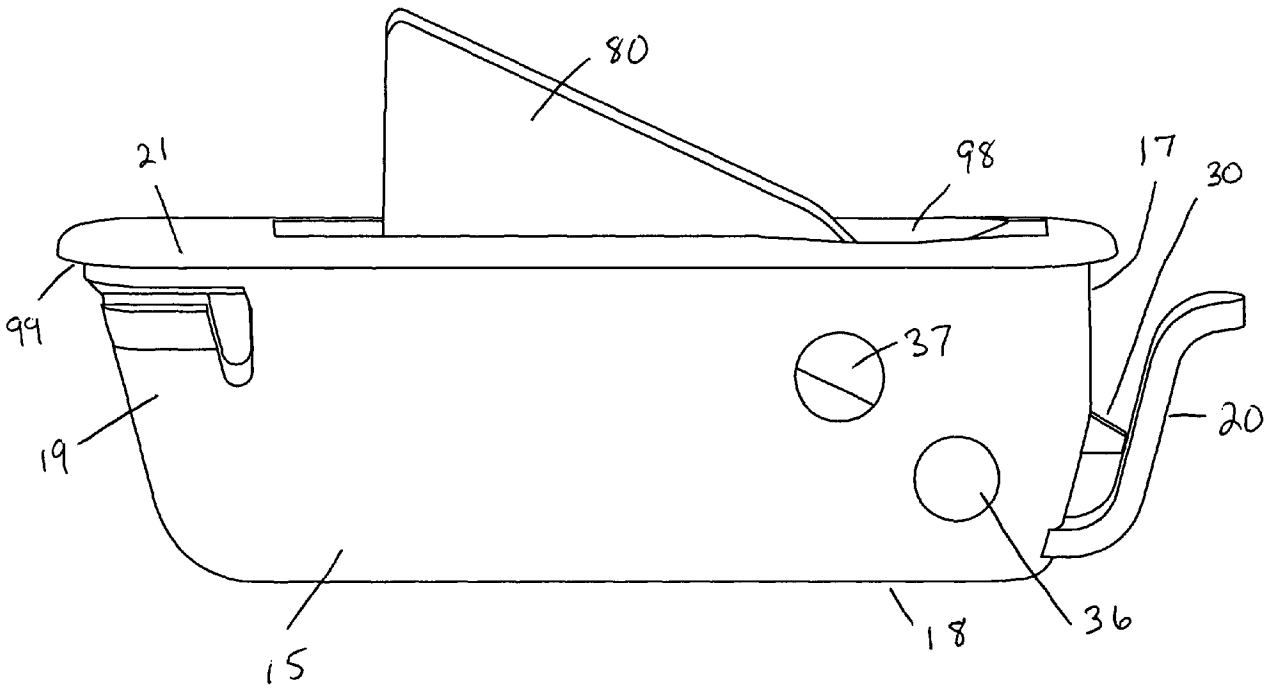
FIG. 9 is a top side perspective view of the vent stop of FIG. 1.
Figure 10:
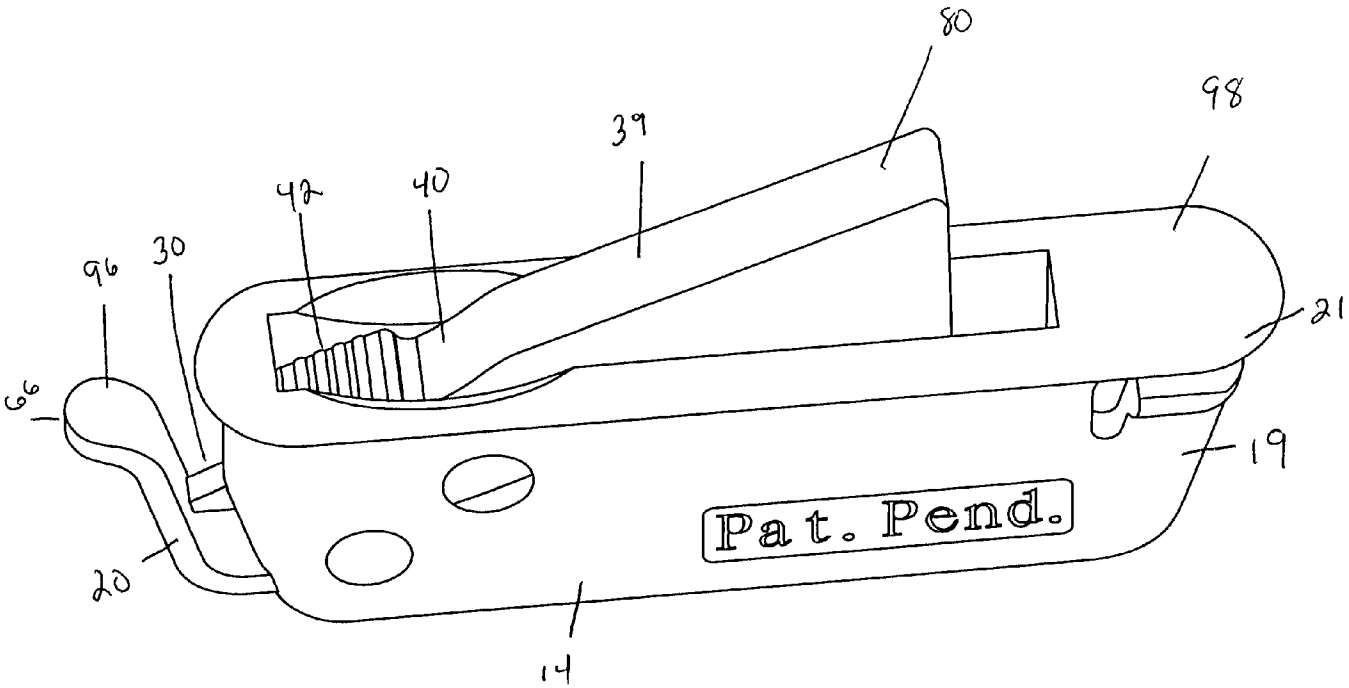
FIG. 10 is a top perspective view of the vent stop of FIG. 1 with the tumbler in the extended position.

In FIG. 1 the window vent stop of the present invention is shown generally at 10. The vent stop 10 is shown positioned over slot 11 in sliding member, such as a window or door sash 12 as seen in FIG. 5. The slot 11 is shown as having an oval shape, but any other suitable shape and size slots including but not limited to a square, rectangle, oval, etc. can be used depending on the shape of the latch. Preferably, however, the vent stop 10 of the present invention will have a portion similarly shaped to the slot 11 as to present a clean appearance when placed in the window sash 12, as seen in FIG. 8. In the present embodiment an oval shape for illustration purposes was used. The window sash can be a sash, doorframe, or any other member that has another piece sliding over it, where restriction of the window sash is desired. The tumbler 80 can be either in a raised or lowered position. When raised it prevents movement of the door or sash, as seen in FIG. 1.

Figure 4:
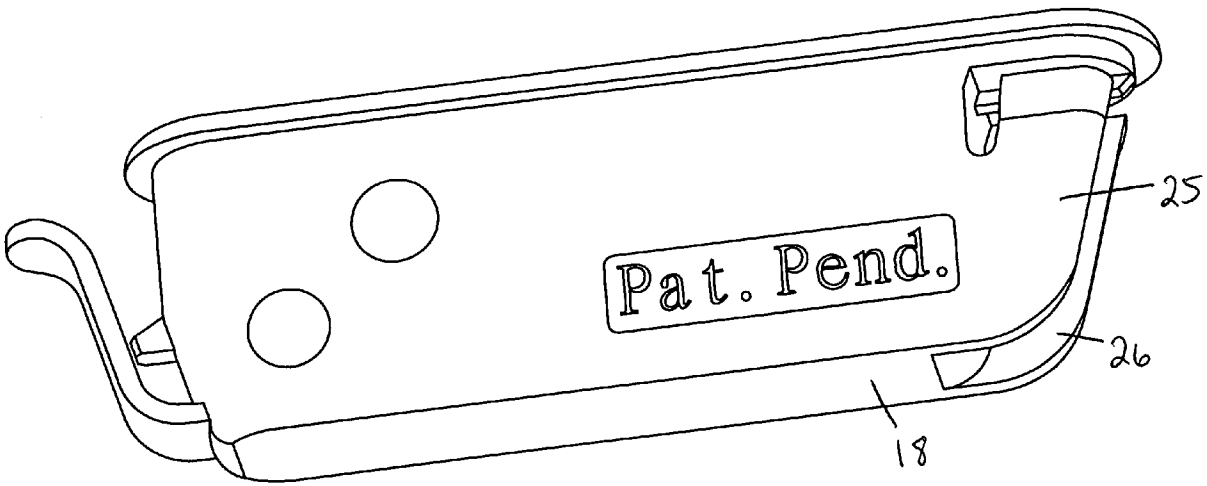
FIG. 4 is a side bottom perspective view of the vent, stop of FIG. 1 with the tumbler in the retracted position.
Figure 15:
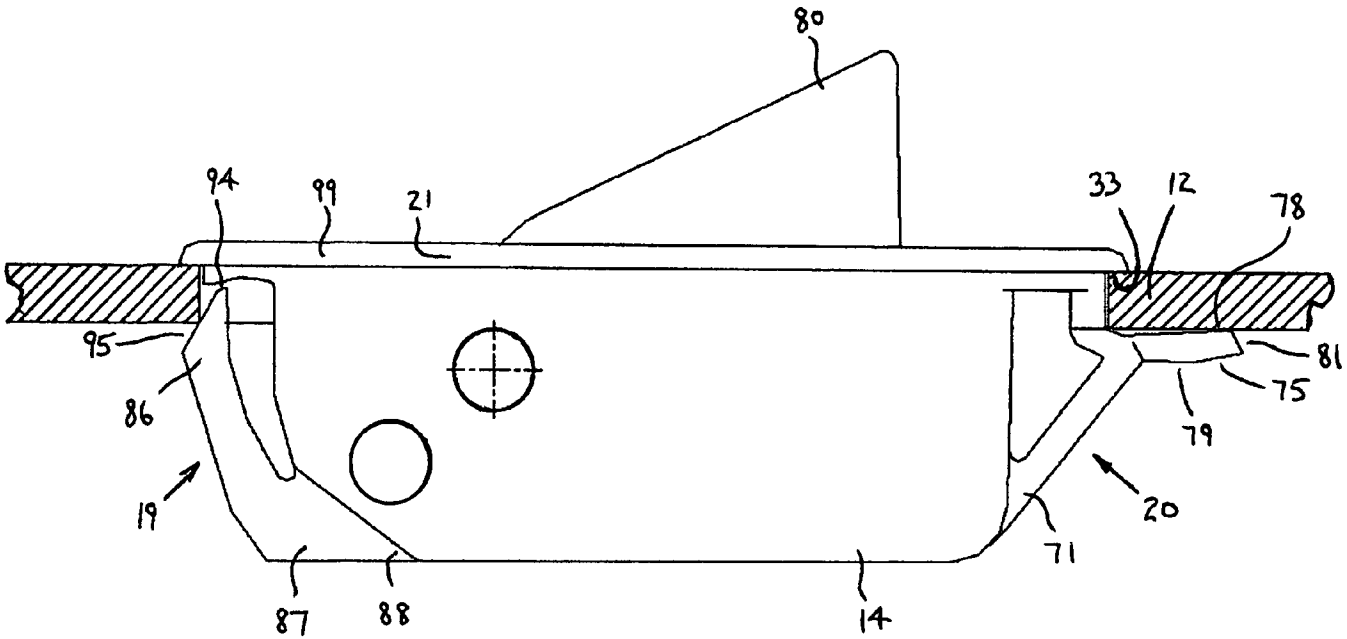
FIG. 15 is a side cross-sectional view of the vent stop of FIG. 14 installed in a sash stile of a greater thickness.

A housing 13 is generally defined by a first sidewall 14, a second sidewall 15, a front wall 16, a rear wall 17, and a bottom wall 18, as shown in FIG. 4. Bottom wall 18 can also serve as a cover. In the present embodiment however bottom wall 18 is sealed, and no cover is present. It is noted that the terms "front" and "rear" are used only for descriptive purposes and do not read on orientation of the device. Sidewalls 14, as seen in FIGS. 1 and 15, are preferably the same length, as are front and rear walls 16 and 17, respectively, providing for a generally rectangular shape to housing 13. Preferably, when in place within slot 11, sidewalls 14 and 15 contact the edges of slot 11 to provide for a tight fit, and prevent a lateral movement of the vent stop 10 within slot 11. There is also a top plate 21 has a top surface 98 and an underside 99, and extends outwardly past the edge of the front and rear walls 16 and 17, creating a lip 33, as seen in FIG. 1. Front wall 16 and rear wall 17 can each have a flexible clip 19 and 20. In one embodiment of the present invention, there is only one flexible clip, first flexible clip 19. However, in the preferred embodiments, there are two clips, first flexible clip 19 and second flexible clip 20. The flexible clips 19 and 20 are preferably not identical, although, in alternate embodiments, they can be identical.

Figure 2:
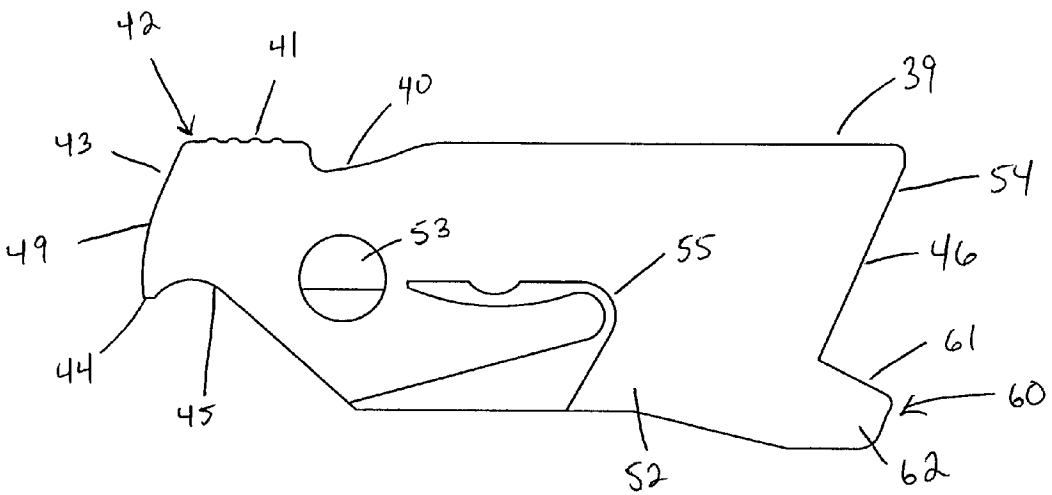
FIG. 2 is a side view of the tumbler of the vent stop of the present invention.
Figure 3:
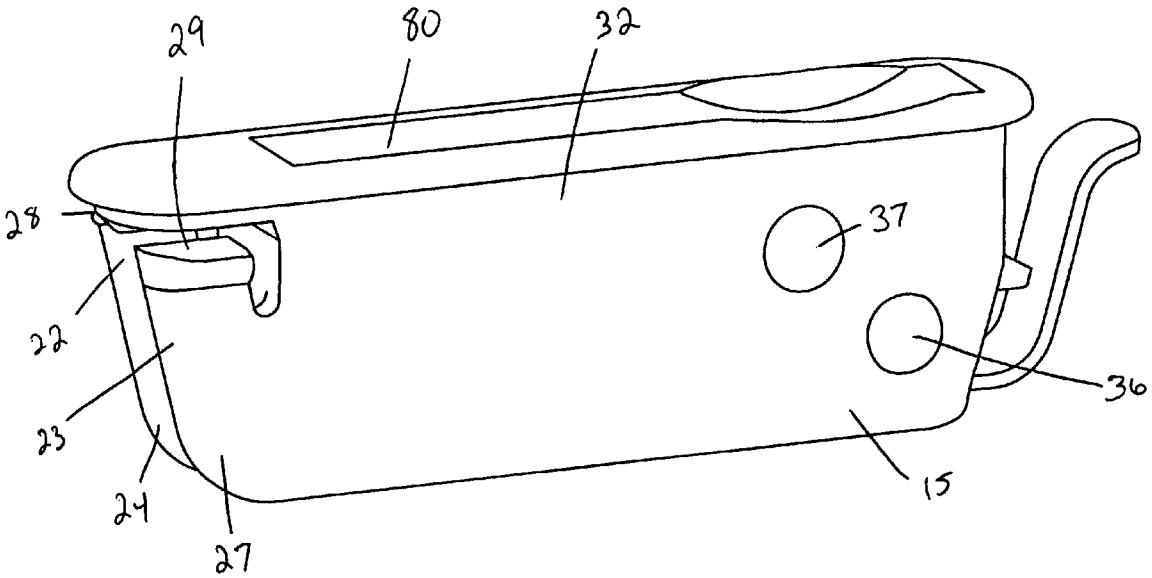
FIG. 3 is a side top perspective view of the vent stop of FIG. 1 with the tumbler in the retracted position.

Either flexible clip 19 or 20 can be attached either front wall 16 or rear wall 17 depending upon a user's preference. As such it should be appreciated, that the embodiments illustrated in FIGS. 1-16 could easily be reversed and the first and second flexible clips 19 and 20 could be on the opposite wall 16 or 17. In one embodiment, illustrated in FIGS. 1-10, first flexible clip 19 can extend generally in an upward fashion, originating at or near the bottom surface 18 of housing 13 and ending typically just below top plate 21, as seen in FIG. 1. In addition, flexible clip 19 may be solid or hollow. In one preferred embodiment flexible clip 19 may split and be comprised of two generally rectangular protrusions, so as to resemble two teeth, a first "tooth"22 and a second"tooth"23, as seen in FIG. 3, located on sidewalls 14 and 15. The first tooth 22 may have inner and outer surfaces, including inner surface 24, as seen in FIGS. 3, and outer surface 25, as seen in FIG. 4, located adjacent to sidewall 14. The second tooth 23 may also have inner and outer surfaces, including inner surface 26, as seen in FIG. 4, and outer surface 27, as seen in FIG. 3, located adjacent to sidewall 15. Flexible clip 19 may be affixed to front wall 16 or flexible clip 19 may be an integral part of housing 13, in the present embodiment flexible clip 19 is an integral part of housing 13. In addition, flexible clip 19 has top surfaces 28 and 29, located on teeth 22 and 23 respectively.

Figure 6:
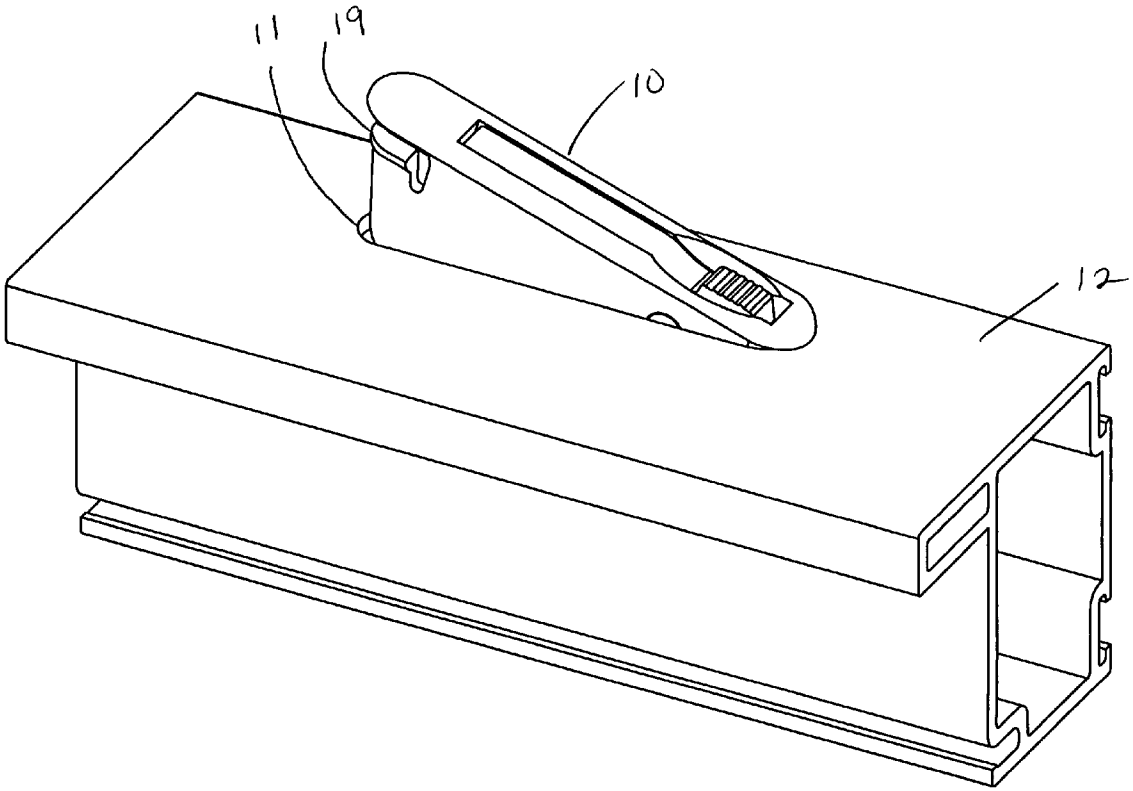
FIG. 6 is a top perspective view of the vent stop of FIG. 1 partially installed in a slot in a window or door sash.
Figure 13:
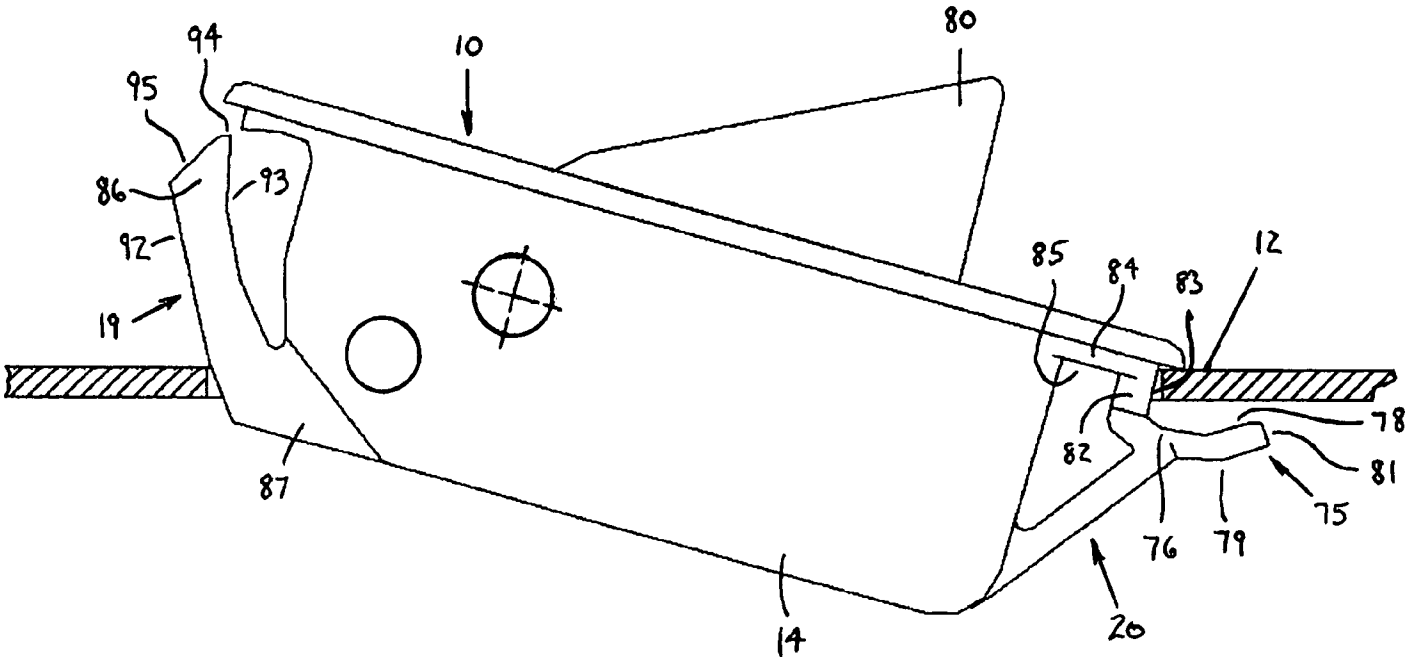
FIG. 13 is a side cross-sectional view of the vent stop of FIG. 11 as it is being installed into a window sash stile.

The second clip 20 ideally has more flexibility than the first clip 19, as seen in FIG. 1, and is adapted to grip the window sash 12 when a user attempts to, install the vent stop, as shown in FIGS. 6 and 13. It may be located at the end of the housing 13. In this embodiment, the vent stop of the present invention can be more compatible with different style doorframes. For greater ease of installation, there is a tab 30 protruding from rear wall 17 of housing 13 as seen in FIG. 1, which ensures enough space between the clip and the housing 13. When the vent stop 10 is depressed into slot 11 on a window sash 12, the second flexible clip 20 should be inserted sideling into slot 11 as seen in FIGS. 6 and 13. Flexible, clips 19 and 20 can engage a portion of the window sash 12, as seen in FIG. 6. This engagement can prevent vertical (front and back) movement of the vent stop 10 within the window sash 12, as well as preventing the vent stop 10 from being easily dislodged from slot 11.

Figure 7:
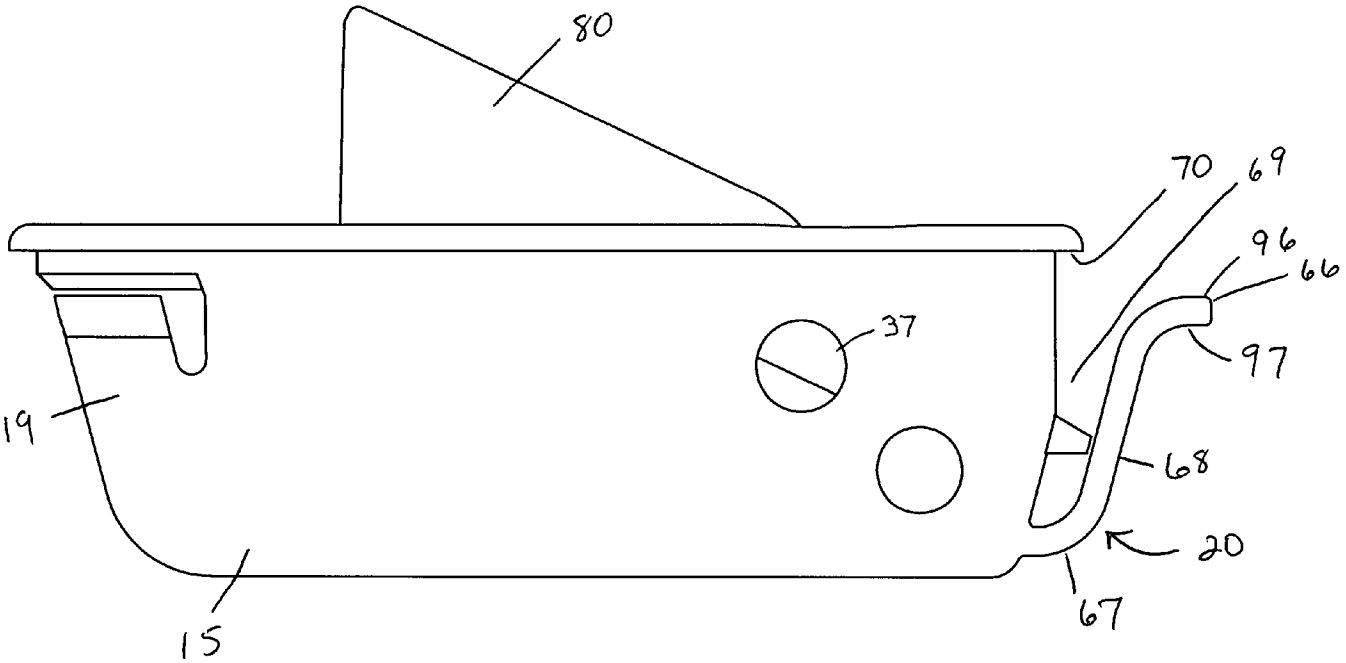
FIG. 7 is a side view of the vent stop of FIG. 1 showing the side opposite the one shown in FIG. 1.

The shapes that second clip 20 could have are virtually endless, so long as the clip 20 maintains its flexibility while still possessing the ability to grip the window sash 12, to provide a clean installation of the vent stop 10. However, in one embodiment, the second clip 20 preferably is "S"-shaped, characterized by curved upper and lower portions 66 and 67, each connected by a generally flat center portion 68, as shown in FIG. 7. In this embodiment, the lower portion 67 of the second clip 20 preferably is connected to the rear wall 17 of the housing 13; nevertheless, the clip 20 could be secured to the housing 13 at any feasible point along the rear wall 17. The lower portion 67 of the second clip 20 is arcuate, curving upward toward the flat center portion 68, creating an S-shaped clip, that strongly resembles the appearance of the "integral" sign in calculus. However, the bottom portion 67 could be curved in an opposite manner, or could even be flat, at an angle to the center portion 68 of the clip 20 in alternate embodiments. In another alternate embodiment, the second clip 20 does not even have a lower portion and the center portion 68 extends diagonally outwardly from the rear wall 17 of the housing 13. The center portion 68 of the second clip 20 extends diagonally outwardly from the lower portion 67, creating a gap 69 between it and the rear wall 17. This gap 69 allows the clip 20 to bend inwardly upon the installation of the vent stop 10. In alternate embodiments, however, the center portion 68 may extend straight in an upward direction from the lower portion 67 rather than outwardly. In other embodiments, the center portion 68 may be more S-shaped, with a portion that extends outwardly from the lower portion 67 and then inwardly toward the rear wall 17. Alternatively the distance the clip 20 maintains between it and the rear wall 17 may be adjustable based on the desired flexibility. The upper portion 66 of the second clip 20 is a generally curved piece, arced in the opposite direction of the lower portion 68. But, in alternate embodiments it may be curved in a different direction, such as upward. The upper portion has top and bottom surfaces 96 and 97 and is positioned such that a line tangent to the top surface is substantially parallel to the top plate 21. The top surface 96 of the upper portion 66 is where the window sash or other window sash 12 may rest when the vent stop is secured. The top surface 96 of the upper portion 66 of the second clip 20, along with the underside of the lip 33 of the top plate 21, act as a gripping mechanism holding the window sash in place. Although the upper portion 66 is generally short, equal in length to the lower portion 67, it may be longer or shorter as desired.

Figure 11:
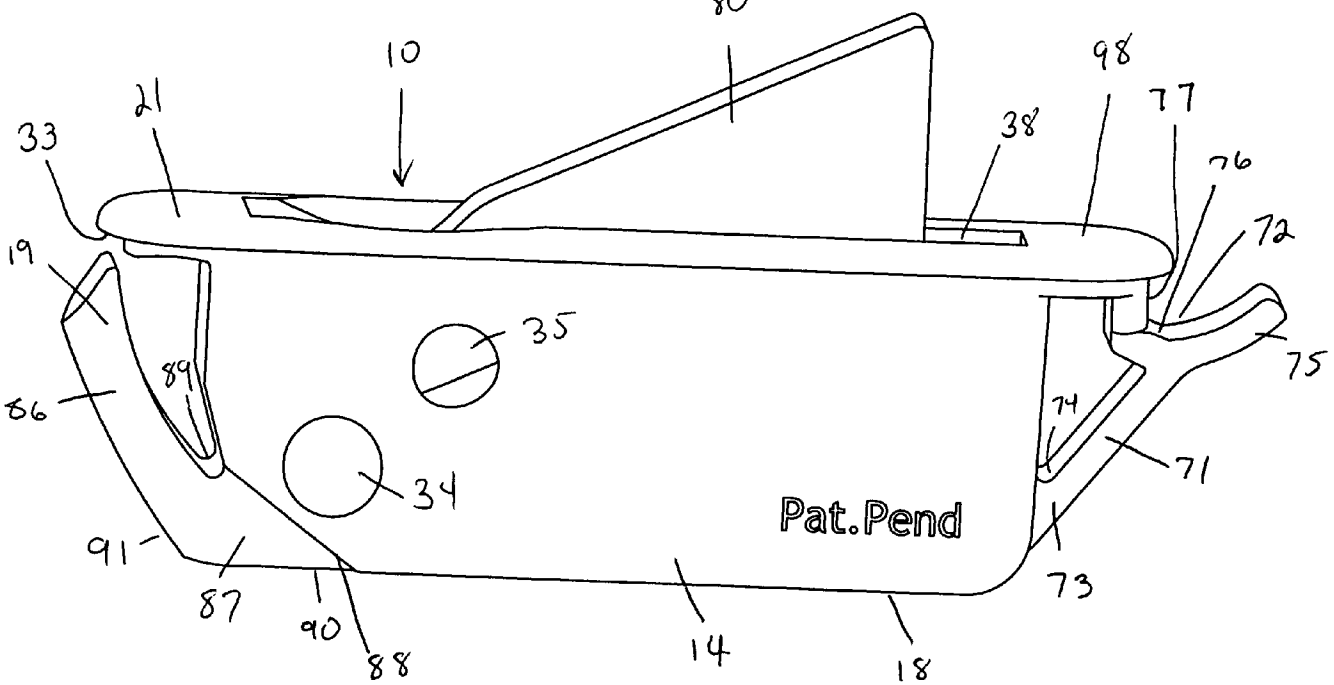
FIG. 11 is a side view of a preferred embodiment of the vent stop of the present invention different from the embodiment in FIGS. 1-10.
Figure 14:
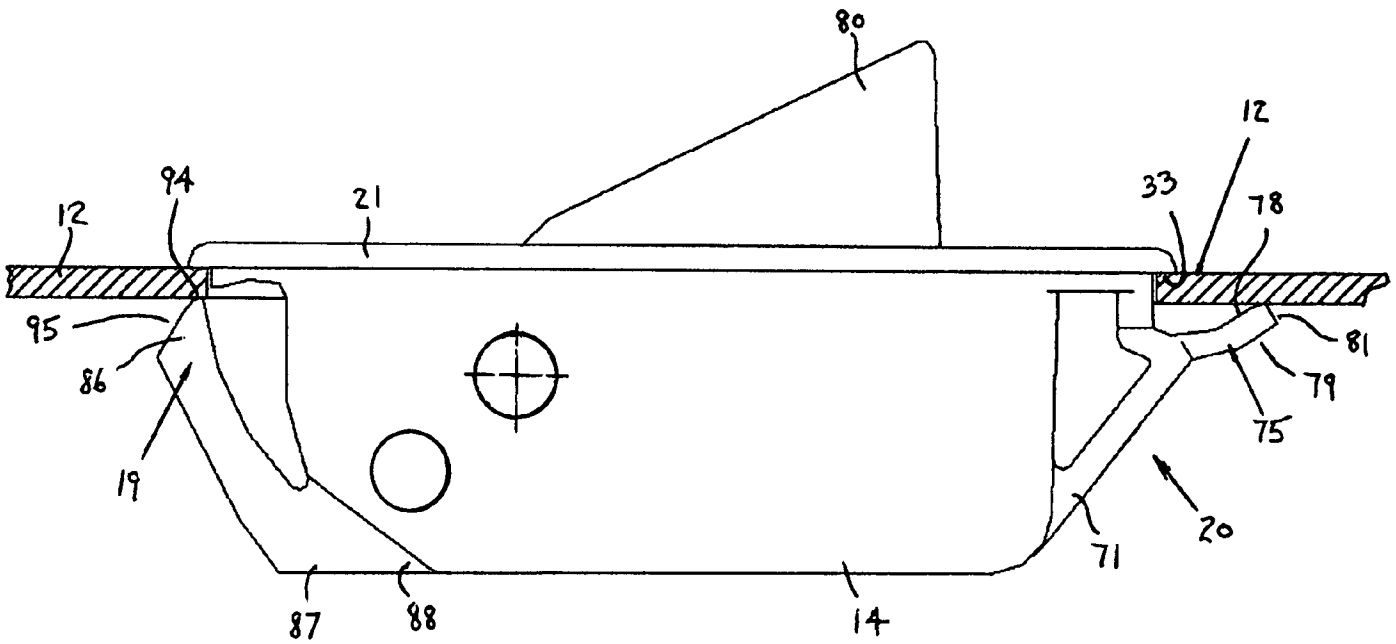
FIG. 14 is a side cross-sectional view of the vent stop of FIG. 13 after it has been installed in the sash stile.

In another preferred embodiment, shown in FIGS. 11-15, the first clip 19 has only one protrusion 86, which extends outwardly from the rear wall 17 of the housing 13. This embodiment of the first clip, is characterized by a protruding arm 86 and a base portion 87 connected to a recessed wall 88 situated between the rear wall 17 and the bottom wall 18 of the housing 13, as shown in FIG. 11. The base portion has top and bottom surfaces 89 and 90 respectively, as well as a rear surface 91, which are all generally flat. Extending from the base portion 87 of the first clip 19 is a single protruding arm 86, which is flexible and is at an angle with the rear wall 17. The arm 86 is generally rectangular, with an inner surface 92, an outer surface 93, a pointed upper surface 94 and a flat side surface 95, as shown in FIG. 13. When the vent stop is slid into the slot 11 in the window sash 12, this embodiment of the first clip will bend inwardly toward the rear wall 17, until the vent stop fits inside the slot. Once the vent stop 10 has been inserted, the protruding arm 86 will release back to its old position further away from the rear wall 17, with the window sash 12 being secured between the pointed upper surface 94 of the first clip 19 and the lip 33 of the top plate 21, as shown in FIG. 14. In alternate embodiments, the shape of the first clip may be changed. For instance, the upper surface 94 does not have to be pointed, and the arm 86 can attach to the housing 13 at a different pointalong the rear wall 17. Additionally, a raised member, or tab could extend outwardly from the rear wall 17 so as to limit the amount of room the arm 86 has to move inward toward the rear wall 17. Essentially, any embodiment practicable to one in the art that would achieve the flexible support described above is possible.

Another preferred embodiment of the second clip 20 of the vent stop 10 of the present invention can also be seen in FIGS. 11-15. In this embodiment, the second clip 20 comprises an arm 71 and a gripping mechanism 72, as shown in FIG. 11. The arm 71 generally has a base portion 73 that extends outwardly from the front wall 16, so that the arm 71 is diagonal to the surface of the front wall 16. In the present embodiment, this base portion 73 is generally characterized by a flat-upper surface 74, and a bottom surface which is indistinguishable from the rest of the arm 71, as shown in FIG. 11. In alternate embodiments, the base portion 73 may be longer or curved, much like the lower portion 67 of the S-shaped clip 20 shown in FIGS. 1-10. The arm 71 is generally flat, although, in alternate embodiments, it may be curved as so desired. Extending from the top of the side opposite the base portion 73 of the arm 71 is the gripping mechanism 72 of the second clip.

The gripping mechanism 72 comprises a protruding hook 75, a flat support surface 76 and a vertical retaining block 77. The protruding hook 75 extends outwardly from the top of the arm 71 of the second clip 20, and it catches the window sash 12 and secures it to the vent stop 10. It is generally curved upward and has top and bottom surfaces 78 and 79 as well as a front surface 81, as shown in FIG. 13. The window sash generally comes into contact with the top surface 78, where it comes to rest securely upon installation, as shown in FIG. 14. Although the hook 75 is generally, curved, it could be flat in another embodiment, as the user desire's. It may be curved in the opposite direction in another embodiment. The hook 75 is connected directly to a flat support surface 76, as shown in FIG. 11, the purpose of which is to further secure the window sash 12 to the vent stop 10. The support surface 76 comes into contact with a vertical retaining block 77, which has a front end 82 and a back end 83, as shown in FIG. 13. This retaining block 77 extends upwardly to the lip 33 of the top plate 21 on the rear end 83, and upwardly toward the underside 85 of an inner flange 84 running parallel to the top plate 21. The retaining block 77 further locks the window sash 12 in place in the clip 20. In various alternate embodiments, each of the various pieces 75, 76, and 77 of the gripping mechanism 72 may be removed. For instance, one embodiment might utilize the hook 75 and the support surface 76, but not the retaining block 77. Any arrangement that would safely secure the window sash 12 within the grip of the clip 20 that is practicable to one knowledgeable in the art is possible.

In alternate embodiments not yet illustrated a variety of configurations of clips 19 and 20 can be utilized. For instance, since the second clip 20 requires only a gripping mechanism for holding the window sash 12 in place while the vent stop 10 is installed, any practicable gripping mechanism may be utilized. One example would simply by two protrusions extending outward from the wall of the housing, with no clip extending upward. One protrusion will fit underneath the window sash 12 and, the other, above it. For the first clip 19, in order to facilitate installation, the clip 19, as seen in FIGS. 11-15 could be concaved on both sides, creating an easier installation into the slot 11 and more flexibility. A final example of an alternate embodiment is if the clips 19 and 20 were on the sidewalls 14 and 15 of the housing 11 rather than the front wall 16 and rear wall 17. In this way, the vent stop 10 could be secured to the window sash 12 in a different manner.

First sidewall 14 has an inner surface, not shown, and outer surface 31, as seen in FIG. 1. Second sidewall 15 has inner surface, not shown, and outer surface 32, as seen in FIG. 3. On sidewalls 14 and 15 there can be four apertures, apertures 34 and 35 on sidewall 14, as seen in FIG. 1, and apertures 36 and 37 on sidewall 15, as seen in FIG. 3. Apertures 34 and 36 of sidewalls 14 and 15, respectively, are aligned along the same central axis and are positioned towards rear wall 17, and are used to prevent tumbler 80 from rotating passed a predetermined area and to support a substantial upward force associated with the lifting of the lower sash against the stopping surface of the latch. Apertures 35 and 37 of sidewalls 14 and 15, respectively, are also aligned along the same central axis; these apertures are designed so as to allow tumbler 80 to rotate in an outwardly fashion. In another embodiment one could implement bored cavities, aligned in a similar fashion, instead of apertures.

In yet another embodiment, sidewalls 14 or 15 may have at least one rotation member extending there from. In this type of embodiment tumbler 80 would have apertures or bored cavities aligned along the same central axis so as to allow tumbler 80 to rotate in an outwardly fashion.

A lip 33 is attached to top plate 21 is preferably at least the same size or larger and the same general shape as slot 11. Thus, when vent stop 10 is placed into slot 11, lip 33 will contact at least the edges of slot 11 or over spread the upper surface of the window sash 12. These dimensional attributes will allow for a tight fit that will exhibit a finished smooth exterior, which can be aesthetically pleasing. Although top plate 21 is referred to as a "plate", it is understood that housing 13, clip 19, lip 33 and top plate 21 can be, integral pieces, without any need for adhesives or assemblage.

In the preferred embodiment second clip 20, attached to the rear of the housing, is preferably almost as high as the lower portion of the housing under the slot 11. Thus, when vent stop 10 is placed into slot 11, clip 20 will contact at least the edges of slot 11 or over spread, the upper surface of the window sash 12. These dimensional attributes will allow for a tight fit that will exhibit a finished smooth exterior, which can be aesthetically pleasing. Although top plate 21 is referred to as a "plate", it is understood that housing 13, clip 19, clip 20 and top plate 21 can be integral pieces, without any need for adhesives or assemblage.

Figure 12:
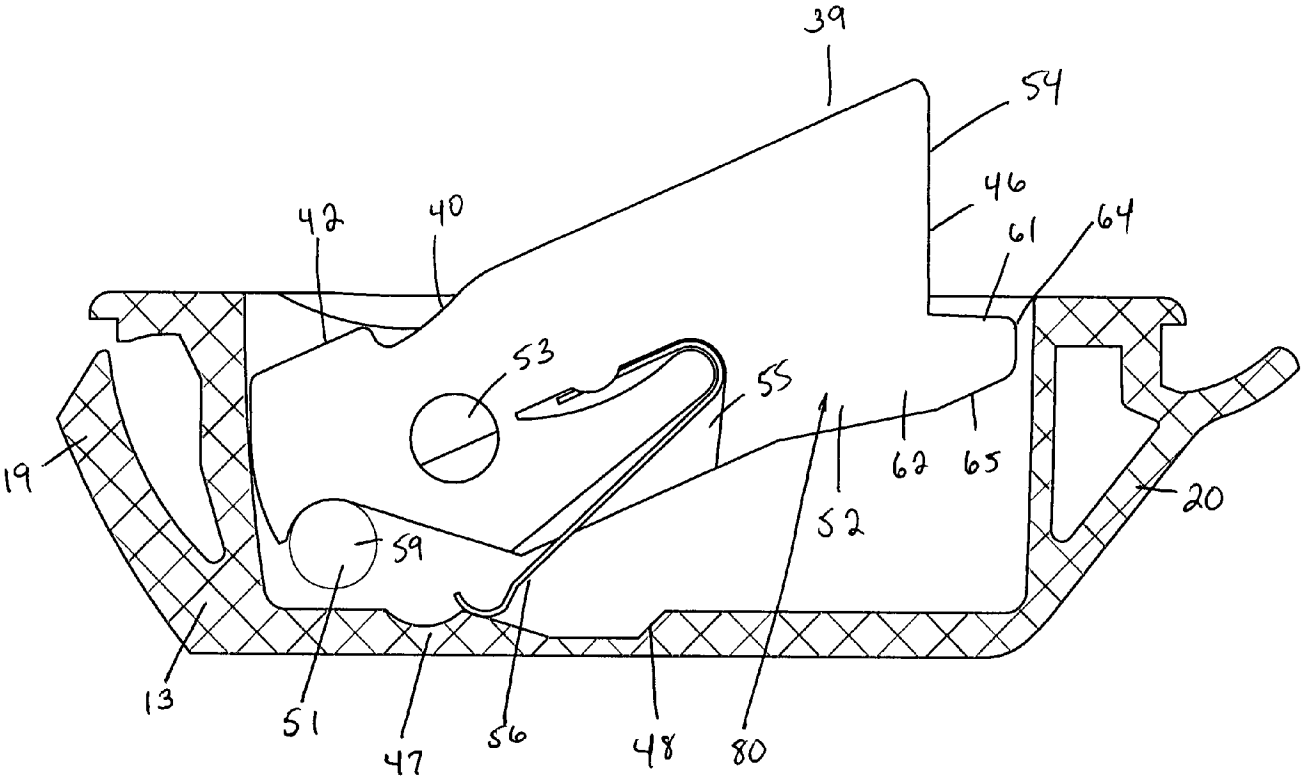
FIG. 12 is a cross-sectional view of the vent stop of FIG. 11.

A tumbler 80 is preferably designed to fit within cavity 38 of housing 13, as seen in FIG. 11. Tumbler 80 may have an upper surface 39, which is preferably smooth and/or flat on the front portion, as seen in FIG. 2. Where upper surface 39 is flat, it will exhibit a more finished look for the vent stop 10 when it is placed in window sash 12. Tumbler 80 may have an indent 40 located toward the rear top surface. In addition tumbler 80 may have a grooved top portion 41 located right above indent 40, as in the present invention, which may act as a button 42, so as to allow the user to activate tumbler 80. The rear edge 43 of tumbler 80 slopes downward and comes to a point 44, where rear edge 43 meets arcuate bottom portion 45. Tumbler 80 can have a front end 46 and a rear end 49, along with side surfaces 52. Tumbler 80 can have rotation members 53, which can fit in apertures 35 and 37, of sidewalls 14 and 15 respectively, of housing 13. The rotation members 53 can be located on side surfaces 52, respectively, close to rear end 49. Preferably, rotation members 53 are cylindrical pegs, which protrude from side surfaces 52 of tumbler 80, respectively. The rotation members 53 can allow tumbler 80 to extend outwardly, thus exposing front end face 54 of tumbler 80, which would prevent movement of window sash 12. The tumbler 80 will be allowed to rotate until arcuate surface 45 of tumbler 80 comes into contact with an arcuate surface 50 of cylindrical peg 51, as seen in FIG. 12, and discussed hereinafter. The window sash may be constructed of any type of material known in the art, but not limited to plastic, metal, wood, etc., capable of withstanding the downward force of tumbler. The window sash may be of any shape known in the art, but not limited to a cylindrical peg, a rectangular block, or a square peg. In the present embodiment a plastic cylindrical peg was implemented. In addition, window sash, cylindrical peg 51, may be separate or an integral part of tumbler 80, in the present embodiment cylindrical peg 51 is a separate member.

Tumbler 80 has a cavity 55 that houses the plate spring 56, as seen in FIGS. 2 and 12. However, this is not the only possible method of attaching a spring to tumbler 80. For example, tumbler 80 can have a protruding peg on either of the side surfaces 52 that could hold the plate spring 56 in place. If this type of spring configuration is implemented, then housing 13 would have to be of such dimensions so as to allow for the additional needed space. Tumbler cavity 55 has a top and bottom surface equal in width to plate spring 56 it houses. Plate spring 56 also has a rounded bottom portion that contacts the left arcuate nest 47 and the right recession 48 in the inner bottom surface 57 of the housing 13 such that the tumbler is forced to a retracted position in the housing or an extended position out of the housing. In another embodiment rounded bottom portion 58 may be replaced by any angled shaped portion known in the art, which is capable of sliding. Inner bottom surface 57 of housing 13 has an arcuate nest 47 for cradling rounded bottom portion 58 of plate spring 56, as seen in FIG. 12. A divide point 59, where the left arcuate nest 47 meets the right recession 48, confines the bottom rounded portion 58 of plate spring 56 to be forced in different directions when the vent stop is activated or deactivated. In normal operation when the user wishes to activate tumbler 80, the user will apply a downward, or inward force to button 42, this will cause rounded bottom portion 58 of plate spring 56 to move out of arcuate nest 47 and pass the divide point 59 and move into the right recession 48 of bottom surface 57 of housing 13. One must point out that arcuate nesting portion 47, divide point 59, right recession 48 of the bottom surface 57 and bottom rounded portion 58 of the plate spring 56 are of great consequence in the operation of this invention.

In addition to the tumbler cavity 55 of tumbler 80, there exists an arcuate surface 45 that interacts with an arcuate surface 50 of cylindrical peg 51. Arcuate surface 45 is preferably located on the rear bottom portion of tumbler 80. Tumbler 80 may have a protruding portion 60 located at the bottom front end wall of tumbler 80, as seen in FIG. 2. The protruding portion 60 has a top surface 61 that extends perpendicularly from the front end face 54 of the tumbler 80. The protruding portion 60 also has a first side 62, as seen in FIG. 2, and a second side, not shown, a frontface 64, and a bottom 65, as shown in FIG. 12. Bottom 65 of the protruding portion 60 extends outwardly in the same direction as top surface 61 so as to meet with the outside edge of front end face 64 and is parallel to the upper surface 39 so as to come into contact with the bottom surface 57 of the housing 13 and limit further rotation of the tumbler 80 in the housing 13 when the tumbler 80 is in the retracted position. The protruding portion 60 may be designed as to allow a meshing between the protruding portion 60 and the bottom surface of top plate 21, which would cause tumbler 80 from further rotating outwardly; thus if needed, protrusion 60 could be used as a limiting device.

The release of the tumbler 80 from housing 13 can be controlled by an interaction between button 42 and plate spring 56 in tumbler 80 and bottom surface 57 of the housing 13. Button 42, as mentioned previously, is located on the rear end portion of tumbler 80, can have a grooved top surface 41, which can be in the same plane as the upper surface 39 of the tumbler 80, where the user can engage button 42 easily with any suitable instrument known in the art, including but not limited to a finger, fingernail, pen, pencil etc., as seen in FIG. 2. When the user engages grooves 41, it will move rounded bottom portion 58 of plate spring 56 from a cradled position to a freed position within cavity 38 of housing 13. In the present embodiment the user applies a downward or inward force to groove 41 of tumbler 80.

When the user wishes to activate tumbler 80, so as to prevent movement of a sliding window member, the user will exert a downward, or upward force, greater than the force being exerted by the rounded bottom portion 58 of plate spring 56 against the top surface of the arcuate nesting area 47 of the bottom surface 57 of housing 13, on groove 41, of button 42. This force will cause plate spring 56 to move in a direction opposite that of the force applied by the user. When the force applied by the user has reached the critical point, it will cause the rounded bottom portion 58 of plate spring 56 to move out of equilibrium with nesting area 47 of bottom surface 57 of housing 13 and slide across divide point 59 of bottom surface 57 of housing 13 and comes in the next equilibrium with right recession 48 of bottom surface 57 of housing 13. The critical point is reached when the force applied by the user overcomes the static frictional force, at which time bottom round portion 58 of plate spring 56 will begin to slide and the frictional force will drop back to a nearly constant value equal to that of the kinetic frictional force. When tumbler 80 is free to pivot on rotation members 53, the upward force of spring 56 will cause tumbler 80 to rotate in an outwardly direction until the rounded bottom portion 58 of plate spring 56 comes into contact with right recession 48 of bottom surface 57 of housing 13. In the same instance arcuate surface 45 of tumbler 80 will come in contact with arcuate surface 50 of cylindrical peg 51. In addition, a protruding portion 60 can also be implemented, so as to further limit movement of tumbler 80 by coming into contact with bottom surface of top plate 21. Once rounded bottom portion 58 of plate spring 56 has stopped sliding tumbler 80 will be exposed, thus preventing sliding window member from opening any further.

As various changes could be made in the above constructions without departing from the scope of the invention, it is intended that all matter contained in the above description shall be interpreted as illustrative and not in a limiting sense.

The operation of the vent stop according to the present invention will be obvious from the above description thereof.

We claim:

1. A vent stop, for use with a sliding sash member, said vent stop comprising: a housing and a tumbler pivotally mounted to said housing for pivotal movement between a retracted position, where said tumbler is disposed within said housing, and an extended position, where a portion of said tumbler extends beyond said housing, a spring configured to bias said tumbler to pivotally travel toward said extended position, and means to limit said biased pivotal travel of said tumbler to said extended position; said housing having a top plate, a first sidewall, and a second sidewall, each of said first and second sidewalls extending from said top plate, said top plate forming a lip with respect to at least a portion of each of said first and second sidewalls, said housing having a front wall and a rear wall, each of said front and rear walls extending from said top plate and extending from said first sidewall to said second sidewall, and said housing comprising a flexible clip on said front wall, said flexible clip extending from said front wall of said housing at a position distal from said top plate, said flexible clip comprising an upper curved portion proximate a distal end of said flexible clip and spaced from said front wall, said upper curved portion positioned such that a line tangent to the upper curved portion is substantially parallel to a bottom surface of said top plate; and said housing comprising a first tooth member and a second tooth member, with each said tooth member extending from said first sidewall and said second sidewall, respectively, and each said first tooth member and said second tooth member extending generally toward said top plate and terminating with a top surface, said second tooth member being adjacent to said first tooth member with an inside surface of said first tooth member being displaced from an inside surface of said second tooth member; each of said first and second tooth members comprising a laterally disposed lip which forms a gap with said top plate.

2. The vent stop according to claim 1 wherein said top surface of each of said first and second tooth members comprises a flat surface.

3. The vent stop according to claim 2 wherein said top surface of each of said first and second tooth members is substantially parallel to said bottom surface of said top plate.

4. The vent stop according to claim 1 wherein said flexible clip is generally "S"-shaped and thereby comprises a lower curved portion and said upper curved portion, said lower curved portion and said upper curved portion being connected by a generally straight center portion.

5. A vent stop, for use in a recess of a sash window to limit travel of the sash window, said vent stop comprising:

a housing, said housing having a first end and a second end, said housing comprising:

a top plate;

first and second sidewalls, said first and second sidewalls being joined to and extending from a bottom surface of said top plate, a front wall and a rear wall, said front and rear walls being joined to and extending from said bottom surface of said top plate and being joined to and extending between said first and second sidewalls to create a cavity; said top plate extending beyond at least a portion of said first and second sidewalls and said front and rear walls to create a lip, said top plate having an opening providing access into said cavity;

a tumbler pivotally mounted to said housing to be pivotable between a retracted position, wherein said tumbler is disposed within said cavity, and an extended position, wherein at least a portion of said tumbler protrudes through and beyond said opening of said top plate;

a spring configured to selectively bias said tumbler to pivotally move toward said extended position;

a flexible clip, said flexible clip fixedly secured to and extending from said front wall of said housing at a position distal from said top plate, said flexible clip comprising an upper curved portion proximate to a distal end of said flexible clip and spaced from said front wall, said upper curved portion positioned such that a line tangent to the upper curved portion is substantially parallel to said bottom surface of said housing top plate;

a first tooth member, said first tooth member extending generally toward said top plate and away from said first sidewall at said second end of said housing and terminating with a top surface; said first tooth member comprising a laterally protruding lip which is spaced from said lip formed by said top plate to form a gap therebetween a second tooth member, said second tooth member extending generally toward said top plate and away from said second sidewall at a said second end of said housing and terminating with a top surface; said second tooth member being adjacent to said first tooth member with an inside surface of said first tooth member displaced from an inside surface of said second tooth member; said second tooth member comprising a laterally protruding lip which is spaced from said lip formed by said top plate to form a gap therebetween.

6. The vent stop according to claim 5 further comprising a stop configured to limit said biased pivotal movement of said tumbler to said extended position.

7. The vent stop according to claim 6 wherein said bottom surface of said top plate, said top surface of said first tooth member, and said top surface of said second tooth member are each generally flat; and wherein said flat top surfaces of said first and second tooth members are substantially parallel to said flat bottom surface of said top plate.

8. The vent stop according to claim 7 wherein said flexible clip is S-shaped and thereby comprises a lower curved portion and said upper curved portion, said lower curved portion and said upper curved portion being connected by a generally straight center portion.

9. A vent stop, for use with a sliding sash member, said vent stop comprising:

a housing, said housing comprising:

a top plate;

a first sidewall and a second sidewall, each of said first and second sidewalls extending from said top plate, said top plate forming a lip with respect to at least a portion of each of said first and second sidewalls;

a front wall and a rear wall, each of said front and rear walls extending from said top plate and extending from said first sidewall to said second sidewall to form a cavity;

a flexible clip on said front wall, said flexible clip extending from said front wall at a position distal from said top plate, said flexible clip comprising an upper curved portion proximate a distal end of said flexible clip and spaced from said front wall, said upper curved portion positioned such that a line tangent to said upper curved portion is substantially parallel to a bottom surface of said top plate; and a first tooth member and a second tooth member, said first and second tooth members extending from said first sidewall and said second sidewall, respectively; said first and second tooth members each extend generally toward said top plate and terminate in a respective top surface; said second tooth member comprising an inside surface being adjacent to, but displaced from, an inside surface of said first tooth member; each of said first and second tooth members comprising a laterally disposed lip which forms a gap with said top plate;

a tumbler pivotally mounted in said housing; and means to bias said tumbler to pivot from a retracted position, where said tumbler is disposed within said cavity of said housing, into an extended position, where a portion of said tumbler extends beyond said housing.

10. The vent stop according to claim 9 further comprising means to limit said biased pivotal movement of said tumbler to said extended position.

11. The vent stop according to claim 9 wherein said flexible clip is generally "S"-shaped and thereby comprises a lower curved portion and said upper curved portion, said lower curved portion and said upper curved portion being connected by a generally straight center portion.

* * * * *